United States Patent [19]

Kimura

[11] 4,271,374

[45] Jun. 2, 1981

[54] ELECTRON GUN FOR CATHODE-RAY TUBE

[75] Inventor: Masamichi Kimura, Ibaraki, Japan

[73] Assignee: Matsushita Electronics Corporation, Osaka, Japan

[21] Appl. No.: 75,035

[22] Filed: Sep. 12, 1979

[30] Foreign Application Priority Data

Sep. 19, 1978 [JP] Japan ..... 53-115523

[51] Int. Cl.[3] ..... H01J 29/56

[52] U.S. Cl. ..... 313/449; 313/460

[58] Field of Search ..... 313/460, 449, 414, 448, 313/412

[56] References Cited

U.S. PATENT DOCUMENTS 2,818,519 12/1957 Gundert ..... 313/449

FOREIGN PATENT DOCUMENTS 828095 5/1938 France ..... 313/448

*Primary Examiner*—Robert Segal

*Attorney, Agent, or Firm*—Burgess, Ryan and Wayne

[57] ABSTRACT

In an electron gun for a cathode-ray tube of the type wherein a cathode, control grid electrode, an accelerating electrode and first and second cylindrical electrodes are disposed in the order named and supported and electrically insulated from each other by electrically insulating rods within a neck portion of an envelope, whereby a main electron lens is formed between said first and second cylindrical electrodes, the second cylindrical electrode comprises an enlarged diameter portion and a reduced diameter end portion which is closer to the cathode and is supported by one end of each of the supporting rods; and the first cylindrical electrode has (1) a neck portion which is extended through the reduced diameter end portion of the second cylindrical electrode coaxially thereof and radially inwardly spaced apart therefrom, and (2) an enlarged diameter front portion which has the diameter greater than that of said neck portion, is extended coaxially therefrom into said enlarged diameter portion of said second cylindrical electrode.

4 Claims, 2 Drawing Figures

ELECTRON GUN FOR CATHODE-RAY TUBE

BACKGROUND OF THE INVENTION

The present invention relates to generally a cathode-ray tube and more particularly an electron gun for a color picture having improved resolution.

In general, the electron guns for cathode-ray tubes may be divided into the bipotential type and the unipotential type which are selected depending upon operating conditions and purposes of use. For instance, the bipotential type electron guns have been used in the picture or display tubes which must display the images with higher resolution because the bipotential type electron guns exhibit better convergence.

The bipotential electron guns comprise, in general, a cathode, a control grid electrode, an accelerating electrode and first and second cylindrical electrodes arranged in the order named. The thermal electrons emitted from the cathode are converged into the electron beam by means of a pre-focusing lens formed by the control grid electrode, the accelerating electrode and the first cylindrical electrode, and the electron beam is focused by the main electron lens formed by the first and second cylindrical lenses so as to strike against the phosphor screen of the cathode-ray tube. In the so-called pentagrid structure, an auxiliary focusing electrode is interposed between the control grid electrode and the accelerating electrode so that more better convergence may be obtained.

In order to minimize the diameter of the electron beam spot striking against the phosphor screen, the spherical aberrations of the electron lenses, especially of the main electron lens, must be minimized as practically as possible. One measure for minimizing the beam spot so far employed is to increase both the diameters of the first and second cylindrical electrodes. However, the increase in diameter of the first and second cylindrical lenses inevitably results in the increase of the neck portion of the cathode-ray tube in which the electron gun is disposed or enclosed, and the increase in diameter of the neck portion results in the inevitable decrease in deflection sensitivity.

In order to overcome the above problems, the cathode, the control grid electrode, the auxiliary focusing electrode, the accelerating electrode and the first cylindrical eiectrode are supported and electrically insulated from each other by electrically insulating rods in the neck portion in the prior art electron guns while the second cylindrical electrode is formed by the deposition of the film of, for instance, graphite, on the inside wall surface of the neck portion. Therefore, it is possible to enlarge the diameters of both the first and second cylindrical electrodes without increasing the diameter of the neck portion. However, the neck portion and hence the second cylindrical electrode has a low roundness. In addition, the correct coaxial alignment cannot be attained between the first cylindrical electrode which is elastically supported by springs in the neck portion and the second sylindrical electrode. As a result, even though the first and second electrodes are increased in diameter, the aberrations of the main electron lens cannot be minimized to a desired degree.

SUMMARY OF THE INVENTION

The primary object of the present invention is therefore to provide an electron gun for a cathode-ray tube wherein the second cylindrical electrode has a low out-of-roundness and a better coaxial alignment may be attained between the first and second cylindrical electrodes so that the aberrations of the main electron lens may be minimized and a better focus of the electron beam can be attained.

Briefly stated, to the above and other ends, the present invention provides an electron gun wherein a cathode, a control grid electrode, an accelerating electrode and first and second cylindrical electrodes are supported in the order named and electrically insulated from each other by electrically insulating rods in the neck portion of an envelope so that the main electron lens may be formed by the first and second cylindrical electrodes. The second cylindrical electrode consists of an enlarged diameter portion closer to the phosphor screen and a reduced diameter end portion contiguous with the enlarged diameter portion and supported by the supporting rods. The first cylindrical electrode includes a neck portion which is extended through the reduced diameter end portion of the second cylindrical electrode coaxially thereof and radially inwardly spaced apart therefrom, and an enlarged diameter front portion contiguous with and extended coaxially of the neck portion into the enlarged portion of the second cylindrical electrode.

BRIEF DESCRIPTION OF THE DRAWINGS

Same reference numerals are used to designate similar parts throughout the figures.

Figure 1:
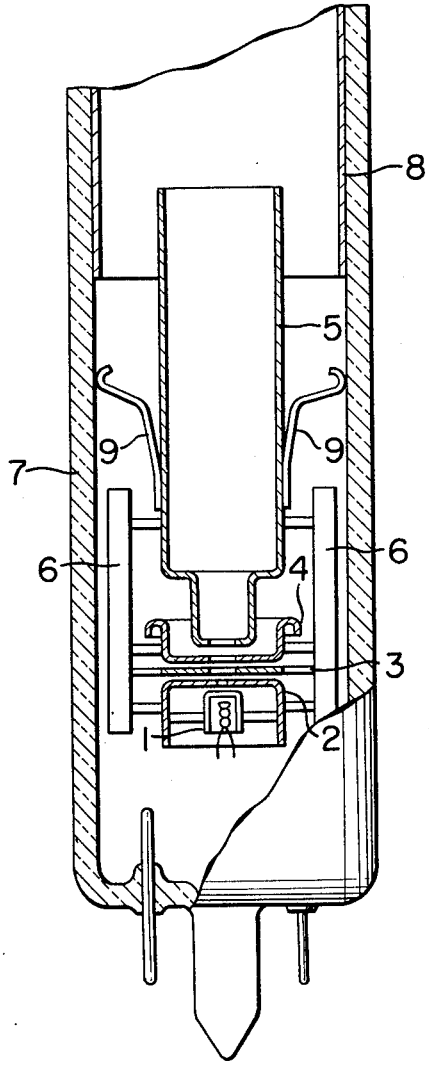
FIG. 1 PRIOR ART
FIG. 1 is a longitudinal sectional view of a prior art electron gun of a cathode-ray tube.

DETAILED DESCRIPTION OF THE PRIOR ART:

In FIG. 1 is shown a prior art electron gun comprising a cathode 1, a control grid electrode 2, an auxiliary focusing electrode 3, an accelerating electrode 4, a first cylindrical electrode 5, supporting rods 6 made of an electrically insulating material and so arranged as to support the electrodes 2 through 5 and insulate them from each other. The above elements 1 through 6 are enclosed in a neck portion 7 which is made of glass. In addition, a second cylindrical electrode 8 is deposited on the inside wall surface of the neck portion 7. with the above arrangement, it is possible to increase the diameters of the first and second cylindrical electrodes 5 and 8 without increasing the diameter of the neck portion 7. However, the neck portion 7 and hence the second cylindrical electrode 8 has a large out-of-roundness, and misalignment tends to occur between the first cylindrical electrode 5 which is elastically supported by springs 9 inside the neck portion 7 and the second cylindrical electrode 8. As a result, even when the first and second cylindrical electrodes 5 and 8 have large diameters, it is difficult to minimize the aberrations of the main electron lens.

DESCRIPTION OF THE PREFERRED EMBODIMENT

Figure 2:
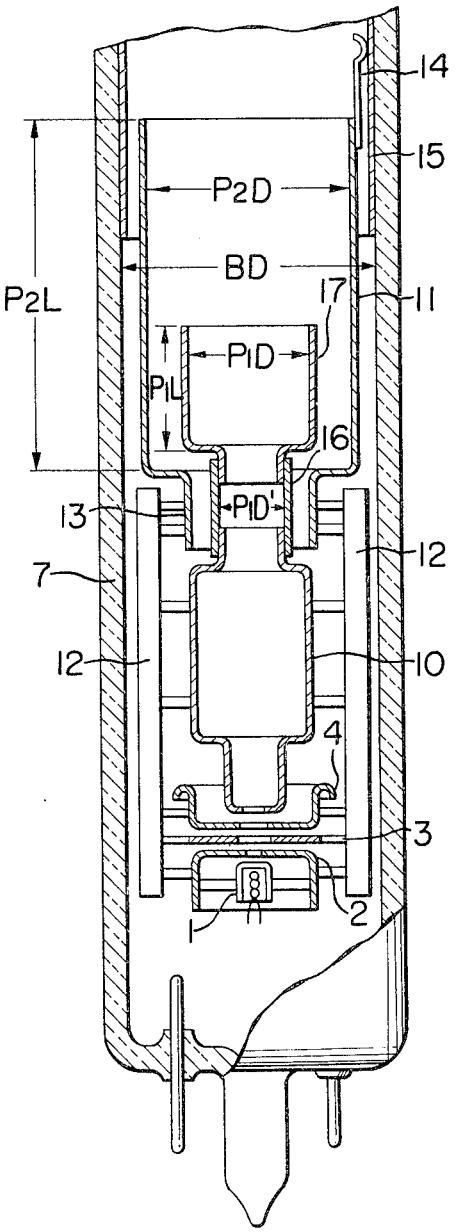
FIG. 2 is a longitudinal sectional view of an electron gun in accordance with the present invention.

In FIG. 2 is shown a preferred embodiment of an electron gun in accordance with the present invention. The cathode 1, the control grid electrode 2, the auxiliary focusing electrode 3, the accelerating electrode 4, a first cylindrical electrode 10 and a second cylindrical electrode 11 are supported by common supporting rods 12 which are made of an electrically insulating material so as to electrically insulate them from each other. The above elements are disposed within the neck portion 7. One end 13 adjacent to the first cylindrical electrode 10 of the second cylindrical electrode 11 is reduced in diameter and is supported by the rods 12. A lip or tongue 14 extended axially from the other end of the second cylindrical electrode 11 is made of an electrically conductive material and is brought into electrical contact with an electrically conductive film 15 deposited on the inside wall surface of the neck portion 7 so that a high voltage may be supplied to the second cylindrical electrode 11 through the conductive film 15.

The first cylindrical electrode 10 includes a neck portion 16 which is extended coaxially of the first cylindrical electrode 10 through the reduced diameter end portion 13 of the second cylindrical electrode 11 in radially spaced apart relationship therewith. The first cylindrical electrode 10 further includes an enlarged diameter front portion 17 which is extended from the front end of the neck portion 16 coaxially thereof and is positioned within the enlarged diameter portion of the second cylindrical electrode 11 in radially spaced apart relationship therewith. Thus the main electron lens is formed between the enlarged diameter front portion 17 of the first cylindrical electrode 10 and the enlarged diameter portion of the second cylindrical electrode 11.

With the above arrangement of the electrodes, the coaxial relationship between the first and second cylindrical electrodes 10 and 11 may be remarkably improved as compared with the prior art arrangement (See FIG. 1). In addition, the inner diameter of the second cylindrical electrode 11 may be very closely approximated to that of the neck portion 7. For instance, when the inner diameter BD of the neck portion is 17 mm, the inner diameter $P_2D$ of the second cylindrical electrode 11 may be 14 mm; the inner diameter $P_1D$ of the enlarged diameter front portion 17 of the first cylindrical electrode 10, 9.5 mm; and the inner diameter $P_1D'$ of the neck portion 16, 6.0 mm. The length $P_2L$ of the enlarged diameter portion of the second cylindrical electrode 11 may be set to 33 mm; and the length $P_1L$ of the enlarged diameter front portion 17 of the first cylindrical electrode 10, 10 mm.

In general, most desirable effects of the present invention may be obtained when the length $P_1L$ of the enlarged diameter front portion 17 of the first cylindrical electrode 10 is substantially equal to the inner diameter $P_1D$ thereof; the inner diameter $P_2D$ of the enlarged diameter portion of the second cylindrical electrode 11 is selected to be from 75 to 90% of the inner diameter BD of the neck portion 7; and the inner diameter $P_1D$ of the enlarged diameter front portion 17 of the first cylindrical electrode 10 is selected to be from 65 to 80% of the inner diameter $P_2D$ of the enlarged diameter portion of the second cylindrical electrode 11.

When the present invention is implemented in the cathode drive type electron gun, the following voltages are applied to the respective electrodes:

Control grid electrode: 0 V
Auxiliary focusing electrode: 270–350 V
Accelerating electrode: 75–500 V
First cylindrical electrode: 2.5–4 KV
Second cylindrical electrode: about 12 KV In summary, according to the present invention, the second cylindrical electrode 11 has a reduced diameter end portion 13 which is supported by the supporting rods 12, and the first cylindrical electrode 10 has the neck portion 13 which is extended through and radially spaced apart from the reduced diameter end portion 13 of the second cylindrical electrode 11 and the enlarged diameter front portion 17 which is extended from the neck portion 13 within the enlarged diameter portion of the second cylindrical electrode 11 so as to coact therewith to form the main electron lens. As a result, the second cylindrical electrode 11 may have a low out-of-roundness, and the coaxial alignment between the first and second cylindrical electrodes 10 and 11 may be attained with a high degree of accuracy. In addition, the large-diameter main electron lens with minimum aberrations may be obtained without increasing the diameter of the neck portion 7 so that the diameter of the beam spot may be minimized. Thus, when the present invention is applied to the beam index type color picture tubes or monitor picture tubes, considerably better resolution may be attained.

What is claimed is:

1. An electron gun for a cathode-ray tube of the type wherein a cathode, a control grid electrode, an accelerating electrode, a first cylindrical electrode and a second cylindrical electrode are disposed in the order named in the neck portion of an envelope and are supported and electrically insulated from each other by electrically insulating supporting rods, whereby a main electron lens is formed between said first and second cylindrical electrodes, CHARACTERIZED in that one end of said second cylindrical electrode which is closer to said cathode is reduced in diameter and is supported by one end of said supporting rods; and said first cylindrical electrode has a neck portion which is extended through said reduced end portion of said second cylindrical electrode coaxially thereof in radially spaced apart relationship therewith, and an enlarged diameter front portion which is extended from the front end of said neck portion coaxially thereof into the enlarged diameter portion of said second cylindrical electrode contiguous with said reduced diameter end portion thereof.

2. An electron gun as set forth in claim 1 further characterized in that said enlarged portion of said first cylindrical electrode located in said enlarged portion of said second cylindrical electrode has the length ($P_1$) substantially equal to the inner diameter ($P_1D$) thereof.

3. An electron gun as set forth in claim 1 further characterized in that the inner diameter ($P_2D$) of said enlarged portion of said cylindrical electrode is from 75 to 90% of the inner diameter (BD) of said neck portion of said envelope.

4. An electron gun as set forth in claim 1 further characterized in that the inner diameter ($P_1D$) of said enlarged diameter front portion of said first cylindrical electrode which is located in said enlarged diameter portion of said second cylindrical electrode is from 65 to 80% of the inner diameter ($P_2D$) of said enlarged diameter portion of said second cylindrical electrode.

* * * * *

UNITED STATES PATENT AND TRADEMARK OFFICE

CERTIFICATE OF CORRECTION

PATENT NO. : 4,271,374

DATED : June 2, 1981

INVENTOR(S) : Masamichi Kimura

It is certified that error appears in the above—identified patent and that said Letters Patent is hereby corrected as shown below:

Column 1, line 60: "sylindrical" should be --cylindrical--.

Column 4, line 49: "$(P_1)$" should read --$(P_1L)$--.

Signed and Sealed this

*Sixteenth* Day of *February 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,271,374

DATED : June 2, 1981

INVENTOR(S) : Masamichi Kimura

It is certified that error appears in the above—identified patent and that said Letters Patent is hereby corrected as shown below:

Column 4, lines 3 and 7 (each occurrence) change "13" to --16--.

Column 4, line 54: change "said cylindrical" to --said second cylindrical--.

Signed and Sealed this

*Eighth* Day of *June 1982*

[SEAL]

*Attest:*

GERALD J. MOSSINGHOFF

*Attesting Officer*

*Commissioner of Patents and Trademarks*